US005953942A

United States Patent [19]

Doucet et al.

[11] Patent Number: 5,953,942

[45] Date of Patent: Sep. 21, 1999

[54] CATCH MECHANISM FOR LOCKS

[75] Inventors: Christian Doucet, Otterburn Park; Dragos-Michael Stanescu, Beaconsfield, both of Canada

[73] Assignee: Ilco Unican Inc., Quebec, Canada

[21] Appl. No.: 08/918,405

[22] Filed: Aug. 26, 1997

[51] Int. Cl.[6] ..... E05B 47/06

[52] U.S. Cl. ..... 70/283; 70/277; 70/149

[58] Field of Search ..... 70/276–283, 134, 70/149; 292/336.3, 336.5, 169.14, 169.15, 169.17, 169.18

[56] References Cited

U.S. PATENT DOCUMENTS

| | | | |
|---|---|---|---|
| 323,918 | 8/1885 | Crockett et al. | 70/149 X |
| 509,194 | 11/1893 | Carty | 70/149 |
| 1,330,650 | 2/1920 | Pehel | 70/134 |
| 4,237,711 | 12/1980 | Kambic | 70/150 |
| 4,390,197 | 6/1983 | Butts | 292/169.15 X |
| 4,429,556 | 2/1984 | Kambic | 70/149 |
| 4,656,850 | 4/1987 | Tabata | 70/282 X |
| 4,682,799 | 7/1987 | Luker | 292/169.15 |
| 4,802,353 | 2/1989 | Corder et al. | 70/278 X |
| 4,820,330 | 4/1989 | Lin | 70/278 X |
| 4,901,545 | 2/1990 | Bacon et al. | 70/278 |
| 4,956,984 | 9/1990 | Chi-Cheng | 70/277 |
| 4,972,694 | 11/1990 | Aulbers et al. | 70/277 |
| 4,995,248 | 2/1991 | Liu | 70/277 X |
| 5,018,375 | 5/1991 | Tully | 70/277 |
| 5,040,391 | 8/1991 | Lin | 70/277 |
| 5,474,348 | 12/1995 | Palmer et al. | 70/283 X |
| 5,475,996 | 12/1995 | Chen | 70/279 |
| 5,640,863 | 6/1997 | Frolov | 70/277 X |

FOREIGN PATENT DOCUMENTS

| | | |
|---|---|---|
| 502 111 | 5/1920 | France . |
| 2 552 809 | 4/1985 | France . |
| 220 509 | 3/1910 | Germany . |
| 845 018 | 8/1951 | Germany . |
| 660 188 | 10/1951 | United Kingdom . |
| 1 150 921 | 5/1969 | United Kingdom . |

*Primary Examiner*—Suzanne Dino Barrett
*Attorney, Agent, or Firm*—Hill & Simpson

[57] ABSTRACT

A door lock comprises a driver hub connected to a door lever, a driven hub, a latch lever movable by the driven hub for retracting the lock's bolt to open the lock, and a catch mechanism for selectively connecting the driver hub to the driven hub. The catch mechanism includes an idle position in which the driver hub moves without moving the driven hub and an engaged position in which the driver hub moves the driven hub and thus the lever and the bolt. A state selection mechanism is provided to displace the catch mechanism between its idle and engaged positions. An actuating mechanism, e.g. a solenoid, selectively positions the state selection mechanism such that the latter causes the catch mechanism, when driven by the driver hub, to adopt one of its idle and engaged positions such that the catch mechanism respectively drives, or not, the driven hub. The actuating mechanism thus allows the state selection mechanism to mechanically cause the catch mechanism to selectively connect or disconnect the driver hub from the driven hub and thus to respectively unlock or maintain locked the door lock. The actuating mechanism typically allows the state selection mechanism to position the catch mechanism in its engaged position, i.e. in its door unlocking position, when activated by a current which results from a valid entry having been recorded in an electronic access control system, or the like.

28 Claims, 8 Drawing Sheets

10

81
22
83
80
84
62
82
14
40
42
46
36
36a
54
60
58
50
52
53
16
64
70
72
56
66
65
18
34
28
32
48
30
78
79
76
74b
20
38
12
44
24
26

10

81
22
83
80
84
62
82
76
74b
20
38
12
44
42
36
14
32
36a
34
46
54
60
58
50
52
53
16
64
72
56
66
70
65
18
30
28
48
78
79
24
26

10

81
24
26
22
83
84
62
80
82
76
74b
20
14
40
42
34
46
36
36a
54
60
58
50
52
53
64
72
56
32
70
66
65
18
30
28
38
12
44
48
78
79

CATCH MECHANISM FOR LOCKS

BACKGROUND OF THE INVENTION

1. Field of the invention

The present invention relates to locks and, more particularly, to a mechanism therefor which selectively enables or prevents the latch bolt from being operated by the door handle or lever, wherein the mechanical drive energy normally used to open the lock is also used to engage or to disengage a driver hub from a driven hub thereby to locked or unlock the lock respectively.

2. Description of the Prior Art

Electromagnetic locks are well known in the art of door locks. Most known devices in this category comprise the following basic elements: a housing, a locking mechanism, a pair of electromagnetic components enclosed therein by a front cover and a rear cover. In such door locks, an electric current is transmitted to an actuation assembly for creating a magnetic field therein to disengageably retract the movable rod of the shift assembly such as to unlock a door. This type of system is disclosed in U.S. Pat. No. 5,475,996, which issued to T-H Chen on Dec. 19, 1995.

Some locks, such as the one disclosed in U.S. Pat. No. 5,040,391 which issued to Jui C. Lin on Aug. 20, 1991, have a mechanism for controlling the dead bolt used in an electronic lock. A clutch and a turning disc must be engaged to each other to open the door. The clutch disc has its center riveted with the core of the electromagnetic coil. The core is movable, having a recover spring set around it. When the core is moved by the powered electromagnetic coil, it can cause the clutch disc to engage the turning disc.

Some other locks, such as the one disclosed in U.S. Pat. No. 5,018,375 which issued to Clay E. Tully on May 28, 1991, have a radial dog which, depending on its position, couples or decouples the spindle and the outer handle. The radial dog is moved by a pin on a rotary motor shaft.

Basically, in the above electronic locks, the action of connecting or disconnecting the driver hub from the driven hub is performed with electric energy. Frequent use and accumulated dirt can affect the reliability and the durability of the electromechanical components and thus of the lock.

SUMMARY OF THE INVENTION

It is therefore an aim of the present invention to provide a lock having an improved catch mechanism.

It is also an aim of the present invention to provide a compact and reliable electromechanical lock.

It is a further aim of the present invention to provide an electromechanical lock that increases security.

It is a still further aim of the present invention to provide an electromechanical lock versatile for a number of applications.

It is an object of the present invention to provide a lock which uses the mechanical drive energy for opening the lock to move a catch selectively connecting a drive hub to a driven hub between an engaged and disengaged position depending on a position of an actuator. In this way, the actuator need not carry out any difficult or heavy movement of parts, and the lock will reliably function.

Therefore, in accordance with a first broad aspect of the present invention, there is provided a lock comprising a driver hub having means for connecting to a source of mechanical drive for opening the lock; a driven hub; latch lever means movable by the driven hub for moving bolt means to open the lock; catch means for selectively connecting the driver hub to the driven hub, the catch means having an idle position in which the driver hub moves without moving the driven hub and an engaged position in which the driver hub moves the driven hub, the catch means movable into one of the idle and the engaged positions; state selection means for moving the catch means into one of the idle and the engaged positions as a result of an initial movement of the driver hub; and actuator means for selectively blocking movement of the state selection means during the initial movement so as to cause the catch means to be driven by the state selection means selectively into one of the idle and the engaged positions, whereby mechanical drive energy is used to change position of the catch means so as to connect or disconnect the drive hub from the driven hub and thus to lock and unlock the lock, while the actuator means select the locked and unlocked state of the lock by blocking or not blocking movement of the state selection means, and the mechanical energy for setting the position of the catch means is derived from the initial movement of the driver hub while the mechanical energy for driving the driven hub to open the lock is derived from a subsequent movement of the driver hub.

Also in accordance with the present invention, there is provided a lock comprising:

- driver means having means for connecting to a source of mechanical drive for opening the lock;
- driven means;
- latch lever means movable by the driven means for moving bolt means to open the lock;
- catch means for selectively connecting the driver means to the driven means, the catch means having an idle position in which the driver means moves without moving the driven means and an engaged position in which the driver means moves the driven means, the catch means movable into one of the idle and the engaged positions;
- state selection means for moving the catch means into one of the idle and the engaged positions as a result of an initial movement of the driver means; and
- actuator means for selectively blocking movement of the state selection means during the initial movement so as to cause the catch means to be positioned by the state selection means selectively into one of the idle and the engaged positions, whereby mechanical drive energy is used to change position of the catch means so as to connect or disconnect the drive means from the driven means and thus to lock and unlock the lock, while the actuator means select the locked and unlocked state of the lock by blocking or not blocking movement of the state selection means, and the mechanical energy for setting the position of the catch means is derived from the initial movement of the driver means while the mechanical energy for driving the driven means to open the lock is derived from a subsequent movement of the driver means.

Further in accordance with the present invention, there is provided a lock comprising a driver hub operable for opening the lock, a driven hub, latch lever means movable by the driven hub for moving bolt means to open the lock, catch means for selectively connecting the driver hub to the driven hub, the catch means having an idle position in which the driver hub moves without moving the driven hub and an engaged position in which the driver hub moves the driven hub, the catch means being movable into one of the idle and the engaged positions, state selection means for positioning the catch means into one of the idle and the engaged positions, actuator means for selectively allowing the state selection means to cause the catch means to be driven by the driver hub into one of the idle and the engaged positions, wherein mechanical drive energy is used to change a position of the catch means so as to connect or disconnect the drive hub from the driven hub and thus to lock and unlock the lock, the actuator means selecting the locked and unlocked state of the lock by blocking or not blocking movement of the state selection means such that when the driver hub is displaced, the catch means assume one of the engaged and idle positions for selectively driving the driven hub and unlocking the lock.

The terms "driver hub" and "driven hub", which typically refer to a central portion of a rotatable member, are not to be limited herein to rotatably mounted members but instead include slideable members, such as is the case of a lock which is opened by translation of a lever instead of turning a knob or handle.

BRIEF DESCRIPTION OF THE DRAWINGS

Having thus generally described the nature of the invention, reference will now be made to the accompanying drawings, showing by way of illustration a preferred embodiment thereof and in which.

DESCRIPTION OF THE PREFERRED EMBODIMENTS

The preferred embodiments of the present invention relate an electromechanical mechanism for locks which selectively enables or prevents the latch bolt from being operated by the door handle, wherein mechanical drive energy is used to engage or to disengage a driver hub from a driven hub respectively in unlocked or locked positions of the lock. The selection of locked or unlock state of the lock is controlled by an electric current which typically results from a valid entry being registered by a keypad, an electronic access control system using, for instance, magnetic cards, and any other identification systems.

Figure 1:
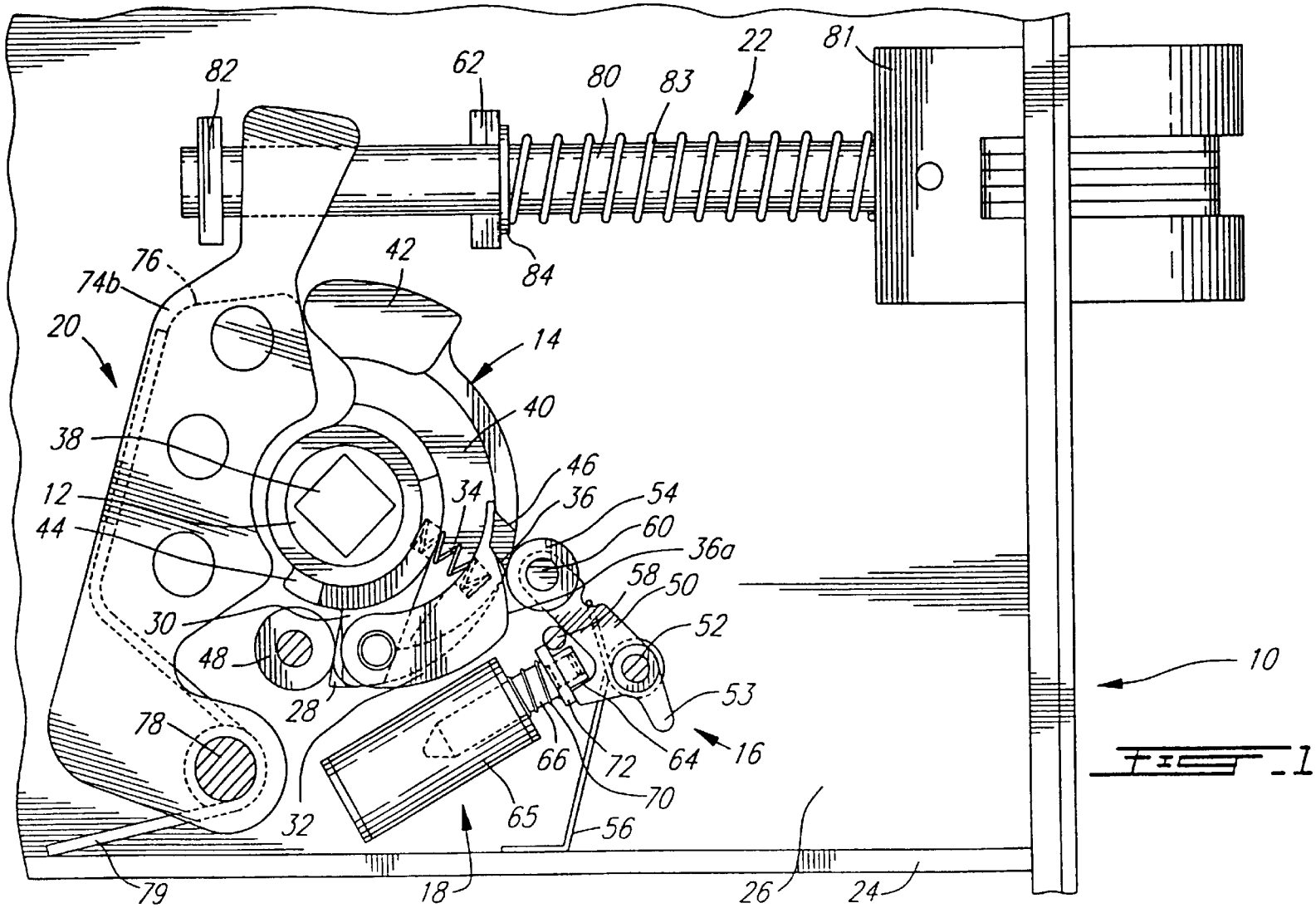
FIG. 1 is a schematic elevational view of a first embodiment of an electromechanical mortise lock provided with a catch mechanism in accordance with the present invention and shown in a locked position thereof.

In the first preferred embodiment, the lock is a door mortise lock which complies with accepted standards for dimensions and operation, such as those set out in the ANSI standards. Now referring to the drawings, and in particular to FIGS. 1 and 4, an electromechanical mortise lock 10 in accordance with the present invention is described hereinbelow.

The mortise lock 10 comprises a driver hub 12, a clutch or driven hub 14, a catch member 36 and a catch abutment 46 on the driven hub 14, a state selection mechanism 16, an actuator mechanism 18, a latch lever 20, a latch bolt 22 and a mortise casing 24 defining an inside cavity or space 26 to receive the various lock components.

Figure 3:
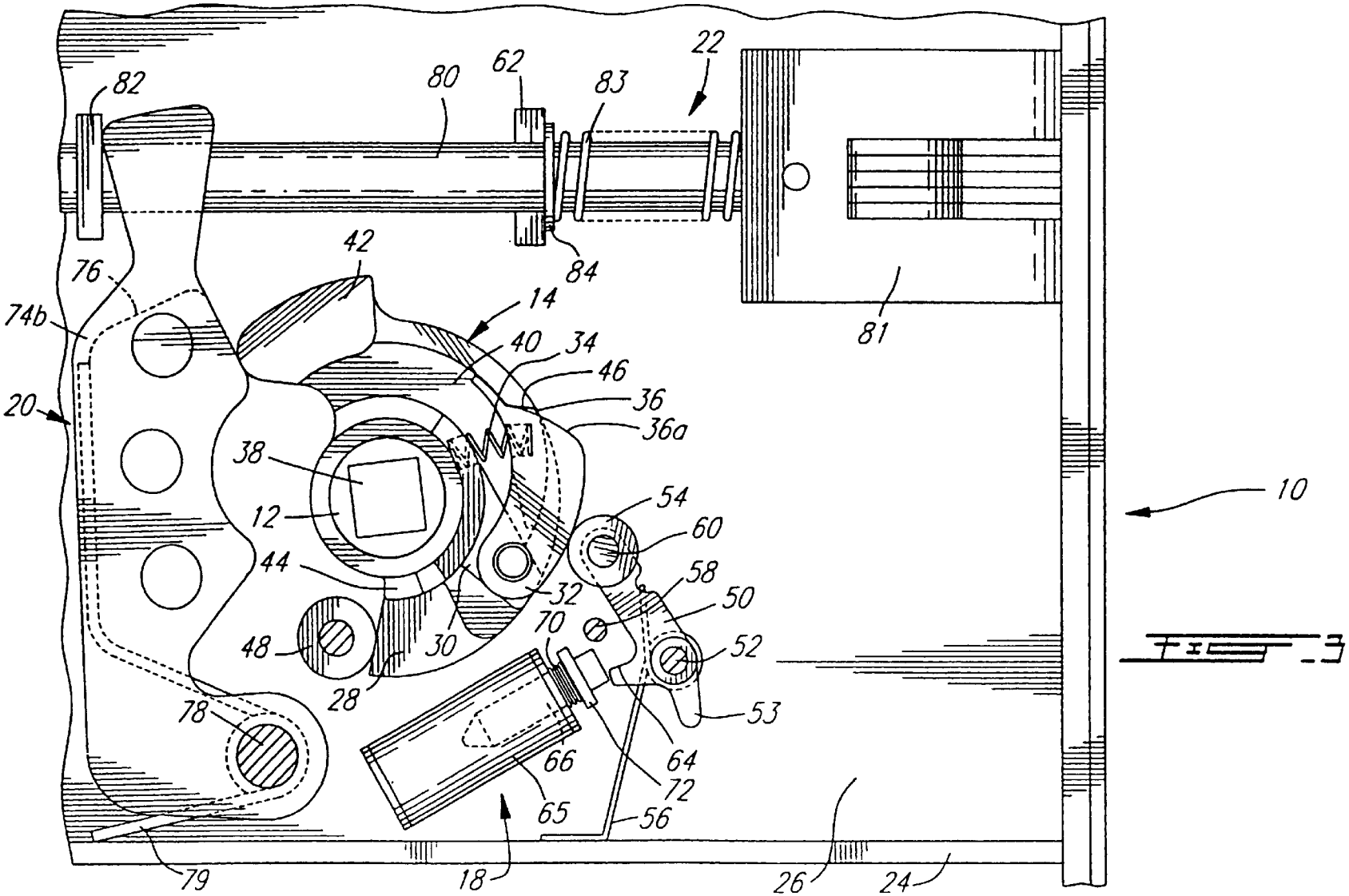
FIG. 3 shows the mortise lock of FIG. 1 in an unlocked position resulting from a valid entry being detected on the electronic access control system thereof, wherein the catch mechanism is in a catch position thereof to permit the outside door handle, when rotate, to open the door.
Figure 4:
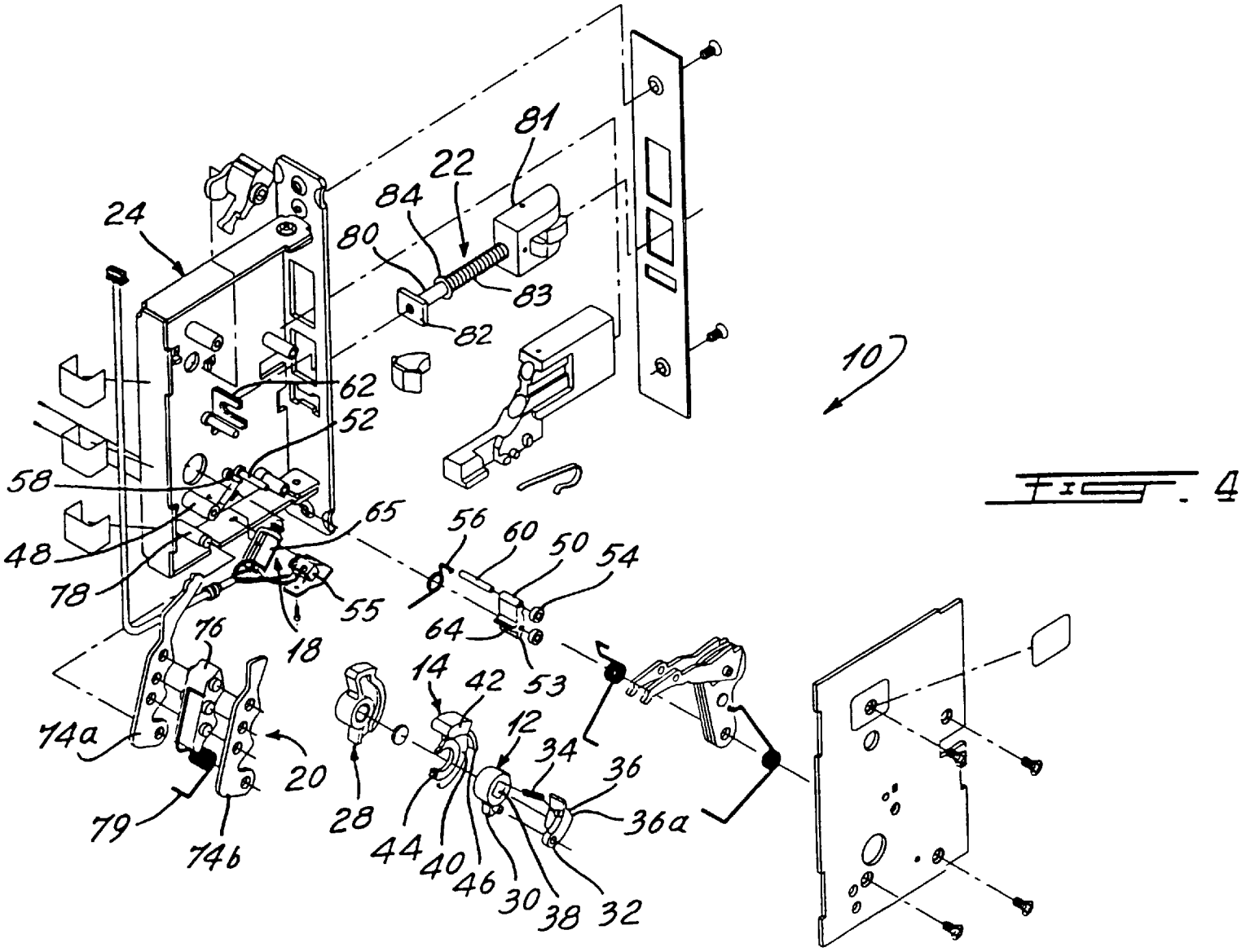
FIG. 4 shows an exploded view of a left hand version of the mortise lock.

The lock mechanism is housed inside the casing 24 which is installed inside a door. The door is provided with outside and inside handle lever spindles. The inside lever spindle extends through the casing 24 and is fixed into a square hole defined in a latch hub 28 which is best shown in FIGS. 3 and 4. The clutch hub 14 has a shape similar to the latch hub 28 and is rotatably fitted thereon so that they are free to rotate independently from each other. The driver hub 12 is freely mounted in a circular groove defined in the center of the clutch hub 14.

The driver hub 12 has a radially extending integral arm 30 with a rounded end of a catch 32 being pivotally mounted on the arm 30 of the driver hub 12 so as to move therewith. The other end of the catch 32 is connected to the driver hub 12 by a compression spring 34. Thus, the catch 32 is held captive between the driver hub 12 and the clutch hub 14 by the outward force of the compression spring 34. The catch 32 is also provided with an actuating surface 36 for engaging the clutch hub 14 after a valid entry. The driver hub 12 is driven by the outside door lever spindle which extends into a square hole 38 defined in the center of the driver hub 12, and its rotation is limited clockwise by a door lever stopper (not shown in the drawings).

The clutch hub 14 defines a channel 40 in order to receive the catch 32 when someone tries to open the door after a non valid entry (or no entry) is detected. The clutch hub 14 also includes a hammer section 42, a stopper section 44 and an engagement surface 46 which are all integral to the clutch hub 14. The stopper section 44 and a post stopper 48 are provided for respectively limiting the clockwise motion of the driver hub 12 and the clutch hub 14. The engagement surface 46 of the clutch hub 14 is designed to eventually come in contact with the actuating surface 36 of the catch 32 when a valid entry is detected (see FIG. 3). The function of the hammer section 42 is to rock the latch lever 20.

The state selection mechanism 16 comprises a cam 50, a cam shaft 52, a cam roller 54, a torsion spring 56 and a stopper pin 58. The cam 50 is provided at one end with a pin 60 which receives the cam roller 54 that will act on the catch 32 to position it in one of its idle and engaged positions. The other end of the cam 50 is rotatably mounted on the cam shaft 52 which is secured on the inside of the mortise casing 24. The cam 50 has a locking finger 64 adapted to cooperate with a solenoid shaft 66 of a solenoid 65, as described hereinafter. Thus, the cam 50 cannot rotate clockwise around the cam shaft 52 if the solenoid shaft 66 is extended and thus engaged with the locking finger 64. Counterclockwise rotation of the cam 50 is limited by the stopper pin 58. The torsion spring 56 is mounted around the cam shaft 52 to return the cam 50 against the stopper pin 58 after a clockwise rotation of the cam 50.

The actuation mechanism 18 comprises the aforementioned solenoid 65 and solenoid shaft 66, a spring 70 and a locking ring 72. When a valid entry is input on a keypad or with an identification card on an electronic access control system, an electric current is generated and sent to the solenoid 65 such as to retract the solenoid shaft 66. The solenoid shaft 66 is spring loaded by the spring 70 held between the locking ring 72 and the cylinder body of the solenoid 65. In its rest, i.e. extended, position, the solenoid shaft 66 is adapted to engage the locking finger 64 of the cam 50 in the locked position of the mortise lock 10. The activation system, e.g. the keypad or the electronic access control system, for the solenoid 65 is known in the art and will thus not be described herein.

The latch lever 20 comprises a long latch lever 74*a*, a short latch lever 74*b*, a spacer 76 between the latch levers 74*a* and 74*b* and a torsion spring 79. Opposite parallel surfaces of the spacer 76 are each provided with three protruding cylindrical pins extending outwardly from these surfaces and fitted into corresponding apertures defined in the latch levers 74*a* and 74*b*, as best seen in FIG. 4. The lower end of the latch lever 20 is pivotally mounted on a lever post 78 which is riveted to the casing 24. The upper end of the latch lever 20 is slidably connected to the latch bolt tail 80 between a latch bolt pusher plate 82 and a latch bolt guide 62 by a coil spring 83 compressed between the latch bolt guide 62 and a head 81 of the latch bolt 22. The latch lever 20 is spring loaded with torsion spring 79 so that the clutch hub 14 is held against the post stopper 48 which is also riveted to the casing 24. The main function of the latch lever 20 is to act on the latch bolt 22 to retract it thereby allowing the door to be opened.

More particularly, the pusher 82 is secured at the proximal end of the latch bolt tail 80 and the head 81 is fixed by a roll pin to the distal end of the tail 80. The spring 83 is mounted on the tail 80 and is held against the latch bolt guide 62 and the latch bolt head 81.

Figure 2:
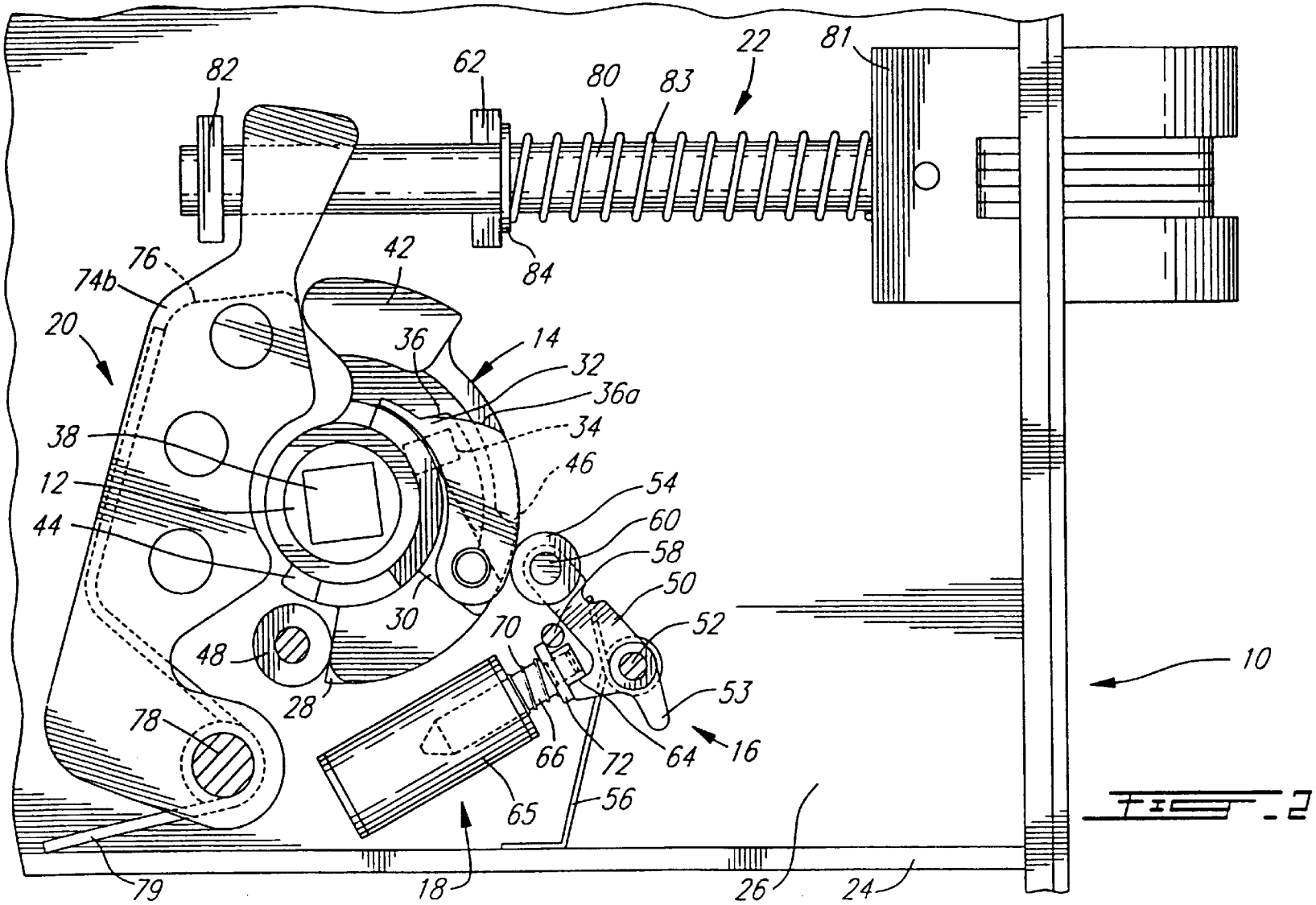
FIG. 2 shows the mortise lock of FIG. 1 in its locked position while an outside door handle is rotated and with the catch mechanism being in an idle position thereof.

Referring to FIGS. 2 and 3, the function of the mechanical and electronic components of the present invention will now be described. When the mortise lock is in its locked state as in the FIG. 2, the solenoid shaft 66 is engaged and abuts the locking finger 64 of the cam 50. In this main position no electric energy is required as, in the rest (i.e. non energized) position of the solenoid 65, its shaft 66 is extended and the lock 10 is in its locked position, whereby preventing drainage of the battery operating the solenoid 65. It is only when a valid entry is registered that the solenoid 65 receives an electrical impulse to retract the shaft 66 and thus disengage this shaft 66 from the locking finger 64. This is best seen in FIG. 3. Therefore, power is only required to unlock the door 10, whereby the power required by this system is nominal.

Referring to FIG. 2, the cam 50 cannot rotate because the solenoid shaft 66 is engaged with the locking finger 64 of the cam 50. Therefore, when an invalid entry is registered and the outside handle is operated with a view to open the door, the driver hub 12 and the catch 32 articulated to it rotate counterclockwise. However, at one point during this movement, the cam's roller 54 comes in contact with cam surface 36a of the catch 32 and, as the roller 54 cannot pivot clockwise with the cam 50 in view of the engagement of the locking finger 64 with the solenoid shaft 66, the catch 32 is forced inwardly by the roller 54 and against the compression spring 34, thereby moving the catch 32 to its idle position shown in FIG. 2, wherein the surfaces 36 and 46 respectively of the catch 32 and of the clutch hub 14 are offset and do not become engaged. The catch 32 and its surface 36*a* slide along the channel 40 of the clutch hub 14 thereby allowing the latter to remain stationary and thus prevent the hammer 42 from pushing on the lever 20 and retracting the bolt head 81. The movement of the driver hub 12 and the catch 32 continues till the lever handle or knob hits a stop plate. When the lever handle or the knob is released, its spring brings it back along with the driver hub 12 and the catch 32 to their rest position shown in FIG. 1. Again, in this situation, the clutch hub 14 was disabled because the actuating surface 36 of the catch 32 passed by the engagement surface 46 of the clutch hub 14. Therefore, there was no engagement between the driver hub 12 and the clutch hub 14 which could have moved the latch lever 20 and thus retract the latch bolt 22 to open the door.

Referring to FIG. 3, when a valid entry is registered, the solenoid 65 receives an electric impulse and its shaft 66 is withdrawn and thus disengaged from the locking finger 64 of the cam 50 and the lock reaches its unlocked state, wherein the cam 50 rotates clockwise around its cam shaft 52 (and against the torsion spring 56) when the surface 36*a* of the catch 32 pushes the cam roller 54. Therefore, when the door lever handle or the knob are moved, the mechanism conjointly moves from the rest position of FIG. 1 to the actuating position shown in FIG. 3. During this motion, the catch 32 pushes the cam roller 54. The compression spring 34 is stronger than the torsion spring 56 so that the cam 50 will be rotated clockwise around its shaft 52 by the catch 32. The actuating surface 36 of the catch 32 then comes in contact with the engagement surface 46 of the clutch hub 14 which turns counterclockwise such that its hammer 42 causes the pivot of the latch lever 20 which itself causes the latch bolt 22 to retract. Then, the door can be opened. At, or right after the position shown in FIG. 3, a tail 53 of the cam 50 while returning to its position in FIG. 1 triggers a switch 55 (see FIG. 4) which sends a signal to the intelligent unit and power to the solenoid 65 is cut, whereby the solenoid shaft 66 plunges out by the action of its spring 70. When the door knob or the lever handle is released, its spring and the latch lever spring 79 bring back the clutch hub 14, the drive hub 12 and the catch 32 to the rest position shown in FIG. 1.

On the other hand, the opening of the door from the inside is possible without any actuation of the solenoid 65. When the inside handle lever spindle is operated, the latch hub 28 pushes the latch lever 20, thereby retracting the latch bolt 22 so that the door can be opened from the inside without the interaction of the drive hub 12 and the clutch hub 14 illustrated in FIG. 3.

A further embodiment in accordance with the present invention is shown in FIGS. 5 to 10 and is described hereinbelow.

Figure 5:
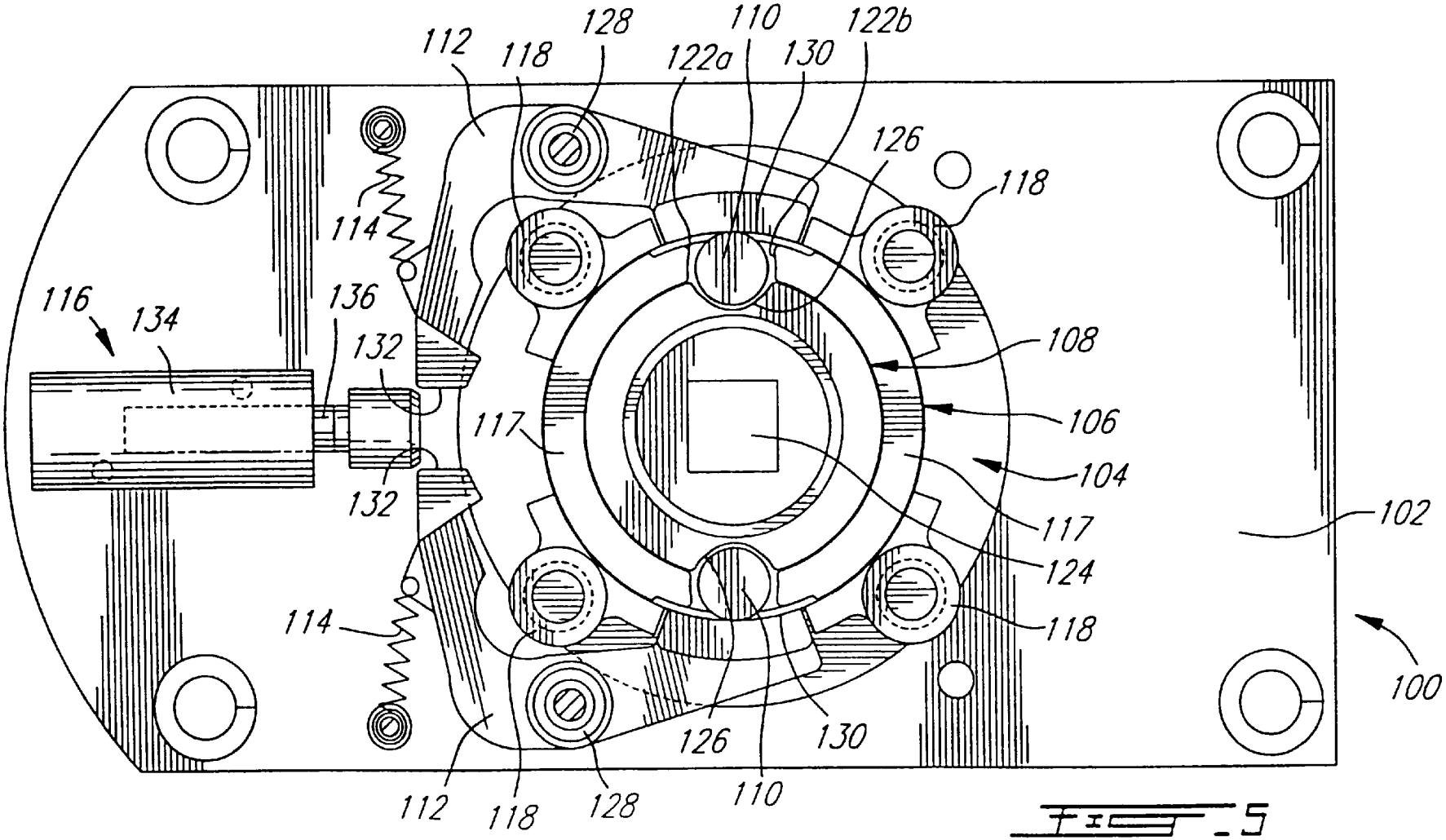
FIG. 5 is a schematic elevational view of a second embodiment of an electromechanical door lock provided with a variant catch mechanism also in accordance with the present invention and shown in a rest or locked position thereof.

Referring to the drawings, and in particular to FIG. 5, an electromechanical door lock 100 comprises a housing having an outside base plate 102, a guide plate 104 secured to the outside base plate 102, an outer or driven hub 106, an inner or driver hub 108, a pair of cylindrical rollers 110, a pair of arms 112 with their tensioned springs 114 and an actuator mechanism 116. As the two catch mechanisms which include the rollers 110, the arms 112, the springs 114 and other associated components to be described hereinbelow are symmetrically mounted around the driven hub 106 and the driver hub 108, the following description will be directed to one of these two catch mechanisms for simplicity purposes, although this description applies to both catch mechanisms.

The lock 100 is installed on a door which is provided with mortise or cylindrical indoor and outdoor handle lever spindles as well as on locks having a single spindle.

Figure 8:
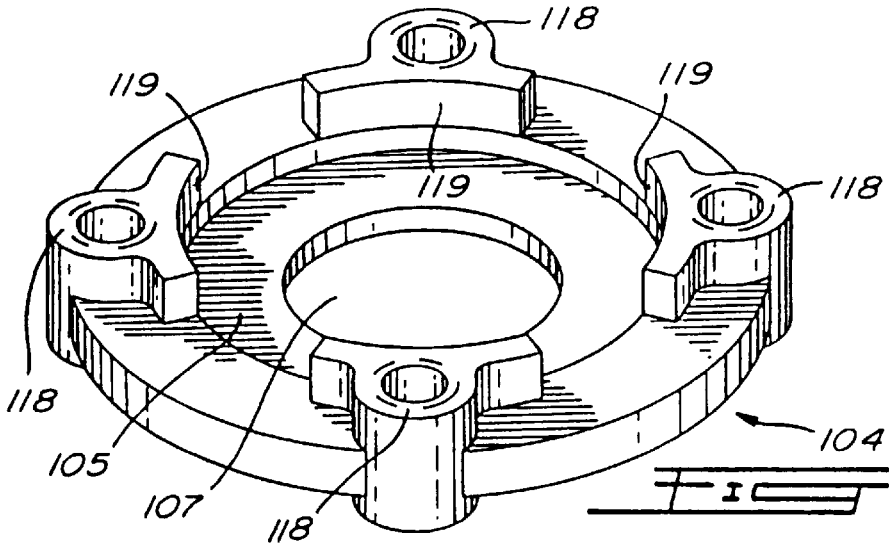
FIG. 8 is a perspective detail view of a guide plate of the door lock of FIGS. 5 to 7.

Now referring to FIG. 8, the guide plate 104 has an annular recess 105, a circular hole 107 formed centrally therein, and four guides 118 each including a screw hole through for fixing the guide plate 104 and the outside base plate 102 at a predetermined position on the door and a curved guide plate 119.

Figure 9:
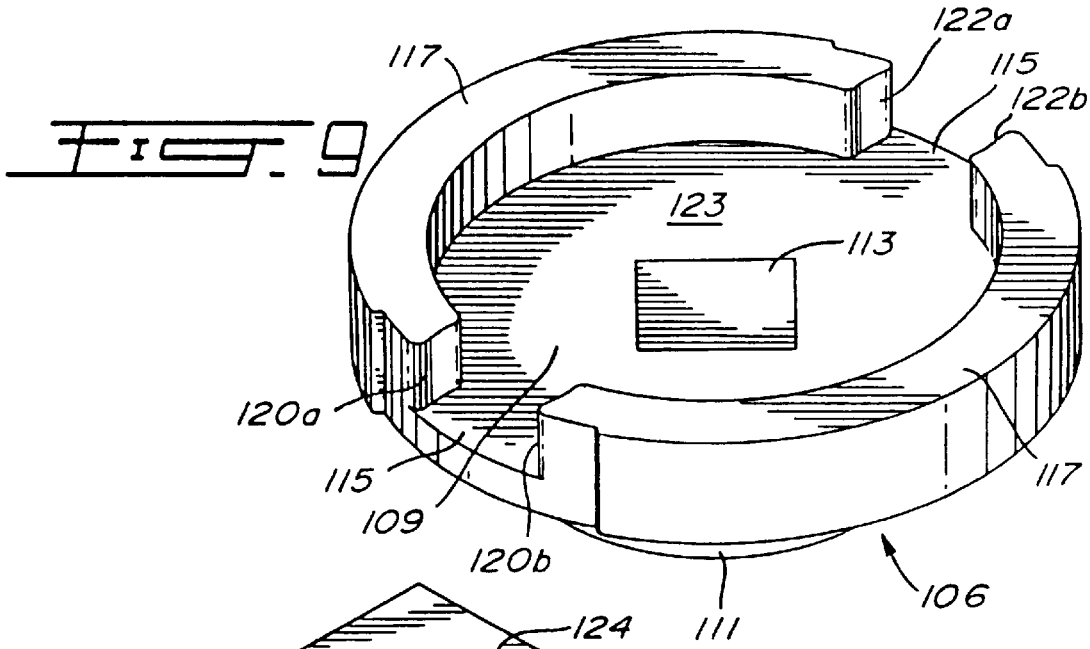
FIG. 9 is a perspective detail view of a clutch outer hub of the of door lock of FIGS. 5 to 7.

Now referring to FIG. 9, the outer or driven hub 106 includes a pair of spaced side walls 117 projecting upward from the periphery of a bottom wall 123 thereby defining a circular cavity 109. A cylindrical neck 111 integrally and concentrically protrudes downward from the bottom wall 123 which defines a central square opening 113 for receiving a spindle. Two spaces 115 are formed on a periphery of the bottom wall 123 and between the side walls 117 which define four engagement surfaces 120*a*, 120*b*, 122*a* and 122*b*.

Figure 10:
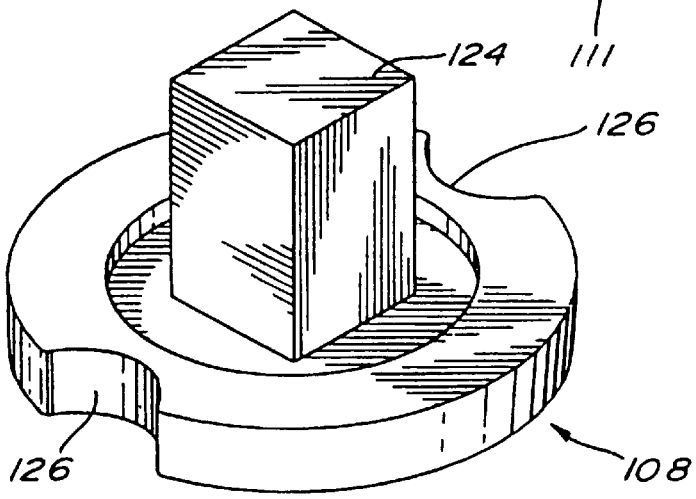
FIG. 10 is a perspective detail view of a clutch inner hub of the door lock of FIGS. 5 to 7.

Now referring to FIG. 10, the inner or driver hub 108 has a rectangular peg 124 projecting upward from its center and two semicircular arched notches formed on its circumference such as to define a pair of driving surfaces 126. The rectangular peg 124 is connected to the outside door handle lever.

The outer hub 106 is rotatably received in the annular recess 105 of the guide plate 104 with the cylindrical neck 111 passing through the circular hole 107 of the guide plate 104 and the outside base plate 102. The outer hub 106 is connected to the latch bolt (not shown) in order to open the door. The inner or driver hub 108 is rotatably received in the circular cavity 109 of the outer hub 106 with its rectangular peg 124 extending away from the outer hub 106.

Each clutch arm 112 is pivotally mounted on an arm post 128 which is fixed on the outside housing base plate 102. The clutch arm 112 is connected to one end of the spring 114 with the other end thereof being fixed to the housing base plate 102. The clutch arm 112 is also provided with a catch roller surface 130 and a state surface 132. The cylindrical rollers 110 are positioned between the driving surfaces 126, the engagement surfaces 120*a*, 120*b*, 122*a* and 122*b* and the catch roller surfaces 130.

Figure 7:
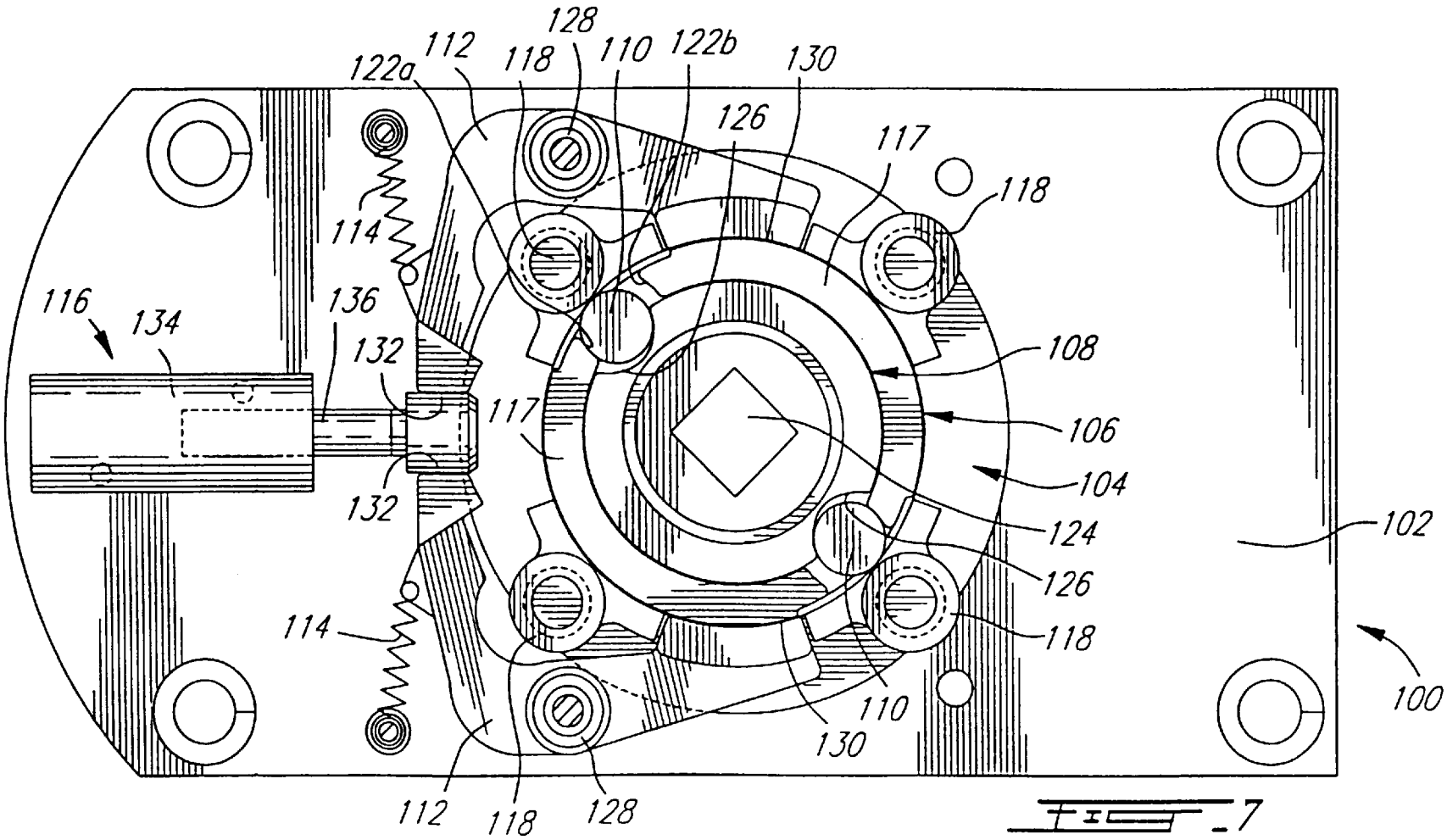
FIG. 7 shows the door lock of FIG. 5 in an unlocked position thereof with the catch mechanism being in a catch position thereof for allowing a rotation of the outside door handle to open the door.

The actuator mechanism 116 comprises a solenoid 134 and a solenoid shaft 136. When the solenoid 134 is engaged between the state surfaces 132 of the clutch arms 112, the system is unlocked, as best seen in FIG. 7 and described in more details hereinbelow. The solenoid shaft 136 is retracted by a spring (not shown) when power is cut to the solenoid 134. Thus, electrical energy is only required to extend the solenoid shaft 136 and unlock the door lock 100.

Figure 6:
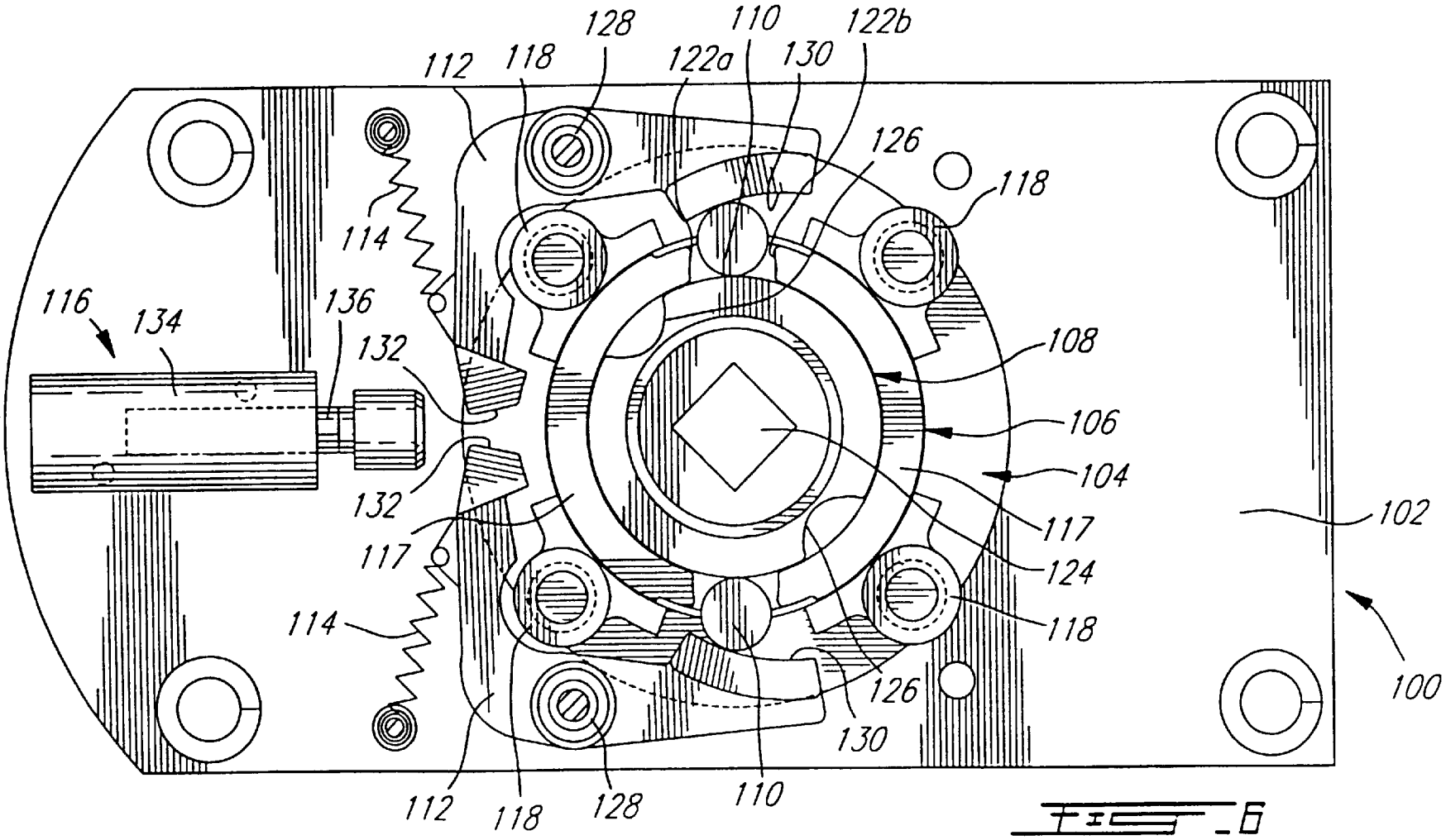
FIG. 6 shows the door lock of FIG. 5 in its locked position with the catch mechanism being in an idle position thereof such as to prevent the rotation of the outside door handle from opening the door.

Referring to FIGS. 5 to 7, the operation of the door lock 100 will now be described.

When an invalid entry is registered, the solenoid shaft 136 is not energized and thus stays retracted, as seen in FIGS. 5 and 6, whereby the clutch arms 112 can rotate around their arm posts 128. Therefore, when the outside door lever handle is rotated, the inner hub 108 rotates from its position shown in FIG. 5 to its position shown in FIG. 6. When the driving surfaces 126 engage the cylinder rollers 110, the latter push on two of the engagement surfaces 120*a*, 120*b*, 122*a* and 122*b* of the outer hub 106 which is spring loaded by the latch bolt at a tension which is stronger than the springs 114 of the clutch arms 112 so that the clutch arms 112 are forced to rotate away from the outer hub 106 with the clutch cylinder rollers 110 being pushed out of their seats and their driving surfaces 126 (see FIG. 6). In this position, the cylinder rollers 110 allow the driver hub 108 to rotate with the outside door handle but without driving the outer hub 106 which is in its idle position. In other words, the door cannot be opened. When the hub door lever is released the inner hub 108 and the clutch arms 112 are brought back to their positions shown in FIG. 5 by their respective springs.

When a valid entry is registered, the solenoid 134 receives an electrical impulse and its shaft 136 is extended out between the state surfaces 132 so that the clutch arms 112 cannot move, as seen in FIG. 7. Therefore, when the outside door handle lever is moved in order to open the door, the inner hub 108 rotates from the position shown in FIG. 5 to the position shown in FIG. 7. The cylinder rollers 110 being trapped between the driving surfaces 126 and the catch surfaces 130 are engaged by the driving surfaces 126 of the inner hub 108, whereby the cylinder rollers 110 push on the engagement surfaces 122*a* and 120*b* (for the counterclockwise rotation of the inner hub 108 illustrated in FIG. 7) thereby forcing the outer hub 106 to rotate. The outer hub 106 is connected to the latch lever (not shown) so that the result of this rotation is the retraction of the latch bolt. When the outside door lever handle is released, the inner hub 108 is brought back to its position shown in FIG. 5 by a spring (not shown). The clockwise and counterclockwise rotation of the inner hub 108 is limited to 45° by a stopper (not shown).

The opening of the door from the inside is possible without any actuation of the solenoid 134. When the inside door handle lever is operated, an inner hub (not shown) which bypasses the catch mechanism pushes the latch lever, which retracts the latch bolt so that the door can be opened from the inside.

It is also easily seen that in a variant embodiment, all rotational movements could be changed for translational displacements. A typical application for this type of lock would be in safes and vaults. The driver hub could be a lever either on the vault door or in the vault frame. Initial sliding of the lever would set the state of the catch means based on the state of the actuator means, and the following movement of the lever would open the vault. The driver and the driven hubs would thus move translationally.

The mechanical energy used to open the lock described with respect to the preferred embodiments is manually derived energy. In an automatic lock, such mechanical energy may be derived from an electromechanical drive, and the invention is able to provide the same benefits.

It will be readily understood that the door locks of the preferred embodiment can be adapted to provide a locked condition to either, or both, door handles and that such a locked position is thus obviously not limited to outside door handles as exemplified in the above-described embodiments, and this depends on whether the door lock is intended control entry or exit, or both. For instance, the present lock can be linked to a fire alarm system or to any other button, or the like, located on the inside in order to selectively allow for any exit therethrough. Furthermore, the present locks can be adapted to doors having a single locked door handle, such as for emergency exits.

We claim as our invention:

1. A lock actuatable by a mechanical drive source, the lock comprising:

a driver hub adapted to be driven by the mechanical drive source;

a driven hub adjacent with the driver hub;

a catch adjacent the driver and driven hubs and having an idle position in which the driver and driven hubs are disengaged and an engaged position in which the driver and driven hubs are engaged by the catch, the catch contacting the driver hub and movable to one of the idle and engaged positions by the driver hub;

a lock opened and closed selector selectively engaged and disengaged with the catch such that the catch is movable between the idle and engaged positions, wherein the lock is locked when the driver and driven hubs are disengaged and the lock is unlocked when the driver and driven hubs are engaged by the catch; and a latch linked to the driven hub and having a first latch position in which the lock is latched and a second latch position in which the lock is unlatched.

2. The lock of claim 1 wherein the lock opened and closed selector further comprises:

a state selector alternatively engaged and disengaged with the catch; and an actuator having a first actuator position in contact with the state selector such that the state selector is engaged with the catch and a second actuator position such that the state selector is disengaged from the catch while remaining in contact with the catch.

3. The lock of claim 2 wherein the actuator further comprises a locking pin having an extended position engaged with the state selector such that the state selector is engaged with the catch and a retracted position disengaged from the state selector such that the state selector is disengaged from the catch.

4. The lock of claim 3, wherein the actuator comprises a solenoid and the locking pin is attached to the solenoid and is retractable when a current is applied to the solenoid.

5. The lock of claim 1 wherein the catch comprises a cam surface and the lock opened and closed selector comprises a roller having first and second roller positions in contact with the cam surface, wherein the catch is moved between the idle and engaged positions when the roller is moved between the first and second roller positions respectively.

6. The lock of claim 5, wherein the cam surface is pivotally mounted to the driver hub and the driver hub is rotatably mounted coaxially with the driven hub.

7. The lock of claim 5, wherein the cam is integral with the catch.

8. The lock of claim 5, wherein the roller is mounted on a lock opened and closed selector cam pivotal between the first and second roller positions.

9. The lock of claim 2 wherein the latch is linked to the driven hub by a latch lever in contact with the driven hub and the latch when the driver hub and the driven hub are engaged by the catch.

10. The lock as claimed in claim 1, wherein the lock is a mortise door lock contained in a casing.

11. The lock of claim 1 wherein the lock opened and closed selector contacts the catch when disengaged from the catch.

12. The lock of claim 1 wherein the lock opened and closed selector comprises at least one movable arm contacting the catch and positioning the catch in one of the idle and engaged positions.

13. The lock of claim 1 wherein the catch comprises a roller positioned in a roller space defined by the driver hub, the driven hub, and the lock opened and closed selector.

14. The lock of claim 13 wherein the lock opened and closed selector comprises an arm movable between first and second arm positions, wherein the arm in the first arm position allows the roller to displace out of the roller space to the idle position such that the driver hub is prevented from driving the driven hub and wherein the arm in the second arm position maintains the roller in the roller space such that the roller is in the engaged position and the driver hub drives the driven hub.

15. The lock of claim 13 wherein the driver hub comprises a roller driving surface at the roller space and the driven hub comprises an engagement surface at the roller space, and wherein the roller driving surface engages the roller and the roller engages the engagement surface when the roller is in the engaged position.

16. The lock of claim 13 wherein the roller is a cylindrical roller.

17. The lock of claim 1 wherein the lock opened and closed selector further comprises:

a state selector alternatively engaged and disengaged with the catch; and an actuator having a first actuator position spaced away from the state selector such that the state selector is disengaged from the catch while remaining in contact with the catch and a second actuator position in contact with the state selector such that the state selector is engaged with the catch.

18. The lock of claim 17 wherein the actuator further comprises a locking pin having a retracted position disengaged from the state selector such that the state selector is disengaged from the catch and an extended position engaged with the state selector such that the state selector is engaged with the catch.

19. The lock of claim 18 wherein the state selector comprises at least one arm having a catch surface in contact with the catch and an arm portion engagable with the locking pin, the catch surface being biased toward the catch.

20. The lock of claim 12 wherein the lock further comprises a substantially symmetrical pair of catches and arms.

21. The lock of claim 1 wherein the catch is mounted to one of the driver hub or the driven hub.

22. The lock of claim 21 wherein the catch is mounted to the driver hub such that the catch moves with the driver hub whether the driver hub is in the idle position or the engaged position.

23. A lock comprising:

a driver hub operable for opening the lock;

a driven hub;

a catch movable between an idle position in which the driver hub and the driven hub are disengaged and an engaged position in which the driver hub and the driven hub are engaged by the catch, wherein the catch is movable to one of the idle or engaged positions by the driver hub;

a state selector associated with the catch and having a first state selector position in which the state selector and the catch cooperate to place the catch in the idle position and a second state selector position in which the state selector and the catch cooperate to place the catch in the engaged position;

an actuator associated with the state selector and having two actuator positions in which one actuator position allows the state selector to be in the first state selector position and the other actuator position allows the state selector to be in the second state selector position; and a latch movable between a first latch position in which the lock is locked and a second latch position in which the lock is unlocked, the latch being movable to the second latch position by the driven hub when the driver hub and the driven hub are engaged by the catch.

24. A method of opening a lock comprising the steps of:

a) selectively placing an actuator in an actuator unlock mode from an actuator lock mode;

b) placing a state selector in a state selector unlock mode by the actuator being in the actuator unlock mode;

c) driving a driver member with a mechanical drive source;

d) engaging the driver member and a driven member with a catch by driving the driver member with the mechanical drive source when the state selector is in the state selector unlock mode;

e) driving the driven member by the engaged driving member with the mechanical drive source; and f) moving a latch from a latched position to an unlatched position with the driven member.

25. The method of claim 24 wherein the catch is mounted on the driver member and step d) comprises the steps of:

contacting the state selector with the catch; and moving the state selector to a state selector unlock position with the mechanical drive source when the driver member and the catch are driven.

26. The method of claim 24 wherein the catch is a roller and step d) comprises the step of rolling the roller along a surface of the state selector with the mechanical drive source when the driver is driven.

27. A lock acuatable by a mechanical drive source, the lock comprising:

a driver hub adapted to be driven by the mechanical drive source;

a driven hub adjacent with the driver hub;

a catch adjacent the driver and driven hubs and having an idle position in which the driver and driven hubs are engaged by the catch;

a lock opened and closed selector selectively having positions engaged and disengaged with the catch such that the catch is movable between the idle and engaged positions, wherein the lock is locked when the driver and driven hubs are disengaged and the lock is unlocked when the driver and driven hubs are engaged by the catch, one of the catch and the lock opened and closed selector haing a cam surface and the other of the catch and the lock opened and closed selector having a cam follower in contact with the cam surface, wherein tha catch is moved between the idle and engaged positions by the driver hub when the lock opened and closed selector is in one of the positions engaged or disengaged with the catch; and a latch linked to the driven hub and having a first position in which the lock is latched and a second latch position in which the lock is unlatched.

28. A lock actuatable bya mechanical drive source, the lock comprising:

a driver hub adapted to be driven by a mechanical drive source;

a driven hub adjacent with the driver hub;

a catch adjacent the driver and driven hubs and having and idle position in which the driver and driven hubs are disengaged and an engaged position in which the driver and driven hubs are engaged by the catch, the driver hub driving the catch to one of the idle and engaged positions;

a lock opened and closed selector selectively engaged and disengaged with the catch such that the catch is movable between the idle and engaged positions, wherein the lock is locked when the driver and driven hubs are disengaged and the lock is unlocked when the driver and driven hubs are engaged by the catch; and a latch linked to the driven hub and having a first latch position in which the lock is latched and a second latch position in which the lock is unlatched;

wherein the catch is loosely positioned in a space defined by the driver hub, the driven hub and the lock open and closed selector.

* * * * *

UNITED STATES PATENT AND TRADEMARK OFFICE

CERTIFICATE OF CORRECTION

PATENT NO. : 5,953,942
DATED : September 21, 1999
INVENTOR(S) : Christian Doucet and Dragos-Michael Stanescu It is certified that error appears in the above-identified patent and that said Letters Patent is hereby corrected as shown below:

Column 1, line 11, should read:

disengage a driver hub from a driven hub thereby to lock

Signed and Sealed this

First Day of August, 2000

*Attest:*

Q. TODD DICKINSON

*Attesting Officer*

*Director of Patents and Trademarks*